United States Patent [19]

Zucchinelli

[11] 3,996,488

[45] Dec. 7, 1976

[54] GETTER DEVICE WITH DEFLECTOR

[75] Inventor: Mario Zucchinelli, Milan, Italy

[73] Assignee: Saes Getters S.p.A., Milan, Italy

[22] Filed: July 18, 1975

[21] Appl. No.: 597,158

[30] Foreign Application Priority Data

July 19, 1974 Italy ..... 25392/74

[52] U.S. Cl. ..... 313/174; 313/181; 417/48; 417/49

[51] Int. Cl.[2] ..... F04B 37/02; F04F 11/00

[58] Field of Search ..... 417/48, 49; 313/174, 313/176, 177, 178, 179, 180, 181

[56] References Cited

UNITED STATES PATENTS

| | | | |
|---|---|---|---|
| 3,719,433 | 3/1973 | Rabusin | 417/48 |
| 3,920,355 | 11/1975 | Zucchinelli | 417/49 |

*Primary Examiner*—R. V. Rolinec
*Assistant Examiner*—Vincent J. Sunderdick
*Attorney, Agent, or Firm*—Littlepage, Quaintance, Murphy & Dobyns

[57] ABSTRACT

A getter device of the annular-ring type having a deflector. The deflector has a conical segment and both axial and radial locating elements. The radial locating element is U-shaped in cross section.

4 Claims, 9 Drawing Figures

GETTER DEVICE WITH DEFLECTOR

Getter devices of the annular-ring type are well known for use in cathode-ray tubes such as television picture tubes. These getter devices are commonly mounted in the so called antenna position by means of an antenna spring attached to the electron gun, as is well known in the art.

When the getter device is heated by induction currents, it releases getter metal, typically barium, in the form of a vapour. This vapour deposits on the inside surfaces of the tube where it functions as a gas sorbing material during the life of the tube. It is desirable to minimize the amount of getter metal on the so called screen of the tube for several reasons. First, since electrons must pass through the getter metal film to strike the phosphors on the screen, the presence of the getter metal film reduces the brightness of the picture. Furthermore, electrons striking the getter metal film can cause undesirable emission of previously sorbed gases. It is also desirable to minimize the amount of getter metal on the electron gun to reduce the danger of electrical break-down of insulating surfaces due to the high voltages present during tube operation.

Attemps have been made in the past to provide getter devices with deflectors in order to direct the getter metal away from the screen and electron gun of the tube. One of the most sucessful devices for directing getter metal away from the tube screen is that shown in FIGS. 1 – 4 of German Offenlegungschrift No. 2,118,268 layed open to inspection on Nov. 4, 1971. However it is desirable to provide a getter device which provides less getter metal on the electron gun than do the getter devices of German Offenlegungschrift No. 2,118,268. A reduction of the amount of the getter metal deposited on the gun has been obtained by the use of known auxiliary deflector means, as shown in FIG. 1 and described in more detail below. However with such getter devices it is difficult to position the deflector in accurately and reproducably aligned relationship with the annular-ring to obtain reproducable evaporation characteristics.

The getter device is usually provided with a support tab by which tab the getter device is attached to one end of an antenna spring as well known in the art. The other end of the antenna spring is then attached to the electron gun of the cathode-ray tube. If the deflector can not be reproducibly positioned relative to the getter device, and its tab, then after insertion within the cathode-ray tube the evaporating barium may not be deflected onto the correct position.

Other prior devices having deflector means are shown in Reash U.S. Pat. No. 3,816,788, Buescher el al. U.S. Pat. No. 2,822,080 and in Japanese patent application No. 47-46165 filed 10 May 1972, published as Japanese patent application publication No. 49-8161.

It is therefore an object of the present invention to provide an improved getter device substantially free from one or more disadvantages of prior getter devices.

Another object is to provide an improved getter device with an accurately aligned deflector relative to the getter device and its support tab.

A further object is to provide an improved getter device which deposits a reduced amount of getter metal on the electron gun of a cathode-ray tube.

Yet another object is to provide an improved getter device which provides a reduced amount of getter metal on the screen of a cathode-ray tube.

Additional objects and advantages of the present invention will be apparent to those skilled in the art by reference to the following description and drawings wherein.

According to the present invention there is provided a getter device comprising a U-shaped annular ring container, a getter metal vapour releasing material, for radially directing a portion of the getter metal and a deflector the structure of which is described more completely below.

The annular ring has a bottom wall together with an inner and an outer wall attached to the bottom wall. The bottom wall may contain openings. The openings in the bottom of the annular ring increase the exposed-surface-area-to-mass ratio of the getter metal vapour releasing material and contribute to the evaporation of substantially all of the getter metal vapour.

Attached to the annular ring is a support tab extending radially beyond the outer wall of the annular ring container.

The deflector employed in getter devices of the present invention has a central depression around a portion of which is placed a concial segment. The deflector also has a radially extending segment attached to both the central depression and the concial segment. Furthermore there is attached to the outer periphery of the horizontal segment an axially disposed locating element adapted to conform to the outer surface of the outer wall of the annular channel. The axial locating element may also be provided with a slot to be positioned over the antenna mounting tab of the getter device. However it is preferable to provide a radially disposed U-shaped cross section locating element attached to the axial element. The radial locating element preferably is substantially coextensive with and conforming to the surface of the support tab to which it may be spot welded.

By virtue of this combined structure, the getter metal released from the getter device is directed preferentially away from both the screen and the electron gun of a cathode ray tube.

Furthermore the deflector is easily located with respect to the support tab and thus with respect to the position of the getter device within the cathode ray tube.

The term "getter metal vapour releasing material" as used in the specification and Claims herein is meant to include both the material prior to and after getter metal vapour release. This term embraces both the material in the form sold with the getter device and in the form in which it is found in an operating tube wherein the major part of the getter metal has been evaporated from the material and is in the form of a film on the inside surface of the tube.

Figure 1:
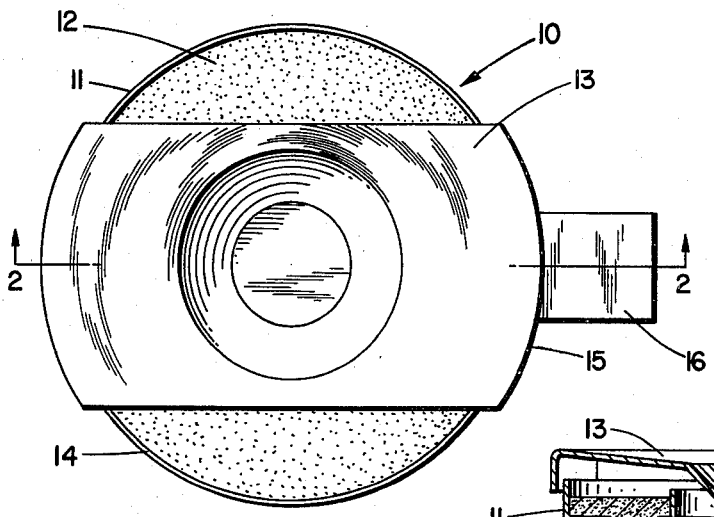
FIG. 1 PRIOR ART
FIG. 1 is a plan view of a known getter device.
Figure 2:
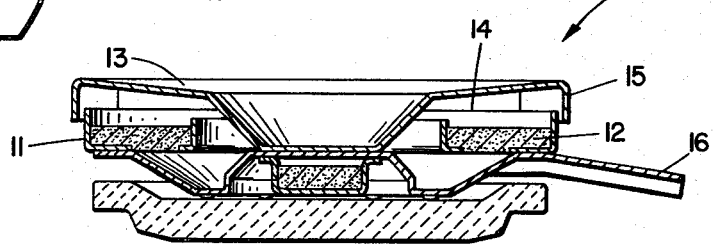
FIG. 2 is a sectional view taken along line 2 — 2 of FIG. 1.
Figure 3:
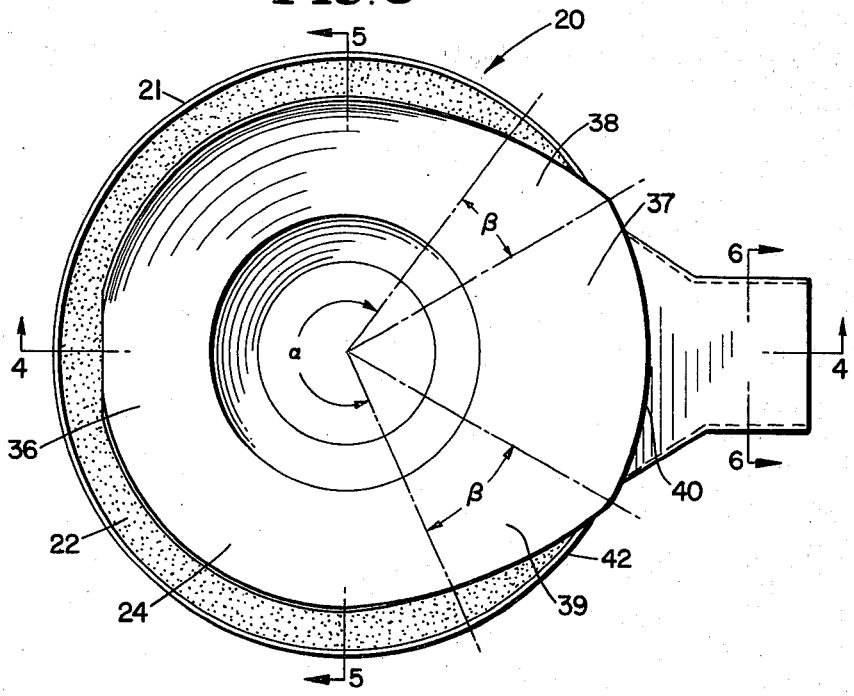
FIG. 3 is a plan view of a getter device of the present invention.
Figure 4:
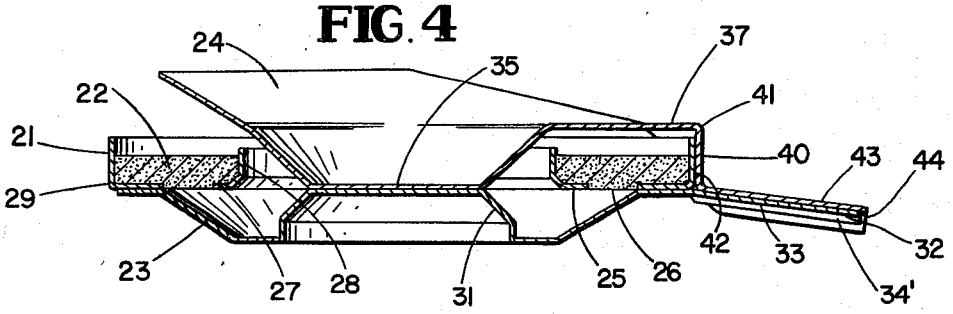
FIG. 4 is a sectional view taken along line 4 — 4 of FIG. 3.
Figure 5:
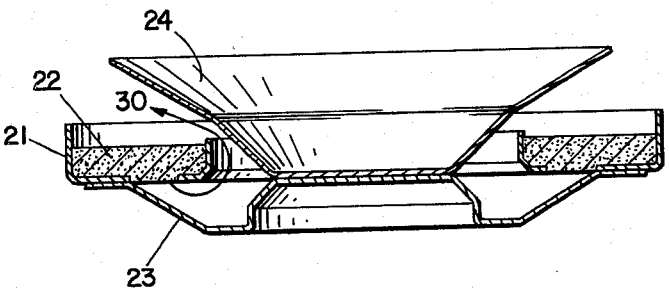
FIG. 5 is a sectional view taken along line 5 — 5 of FIG. 3.
Figure 6:
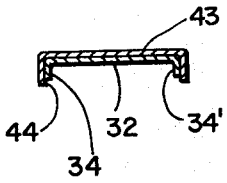
FIG. 6 is a sectional view taken along line 6 — 6 of FIG. 3 and is identical with the sectional view taken along line 6 — 6 of FIG. 7.

Referring now to the drawings and in particular to FIGS. 1 and 2 there is shown a known getter device 10 comprising a U-shaped annular ring 11 containing a barium releasing material 12. Getter device 10 is provided with a deflector 13 formed of a conical segment 14 and an axially disposed segment 15 which acts as an auxiliary deflector means to reduce the amount of getter metal deposited on the gun of the cathode ray tube. A support tab 16 is attached to annular ring 11. In FIGS. 3, 4, 5 and 6 there are shown a getter device 20 of the present invention. The getter device 20 comprises an annular ring 21, a getter metal vapour releasing material 22, a disc member 23 and a conical deflector 24. The annular ring has a bottom wall 25 having openings 26, 27 therein. Attached to the bottom wall 25 is an inner wall 28 and an outer wall 29.

In the embodyment of FIGS. 3 to 6 the disc member 23 is attached to the bottom wall 25 of the ring 21 at a point adjacent to the outer wall 29. This attachment is effected in a substantially vapor tight manner such that getter metal vapour coming from material 22 through the openings 26, 27 will not escape from the device 20 between the disc member 23 and the bottom wall 25. This getter metal vapour travels substantially the path designated by arrow 30. In this case disc member 23 has a raised central portion 31. In addition disc member 23 has a spport tab 32 comprising a strip 33 integral with disc member 23 and extending radially outwards to a distance greater than the radius of outer wall 21.

Edges 34, 34' of strip 33 are bent substantially at right angles to strip 33 to make a more rigid structure.

The deflector 24 has a central depression 35 which is in contact with the raised central portion 31 of disc member 23. A conical segment 36 is disposed for an angle $\alpha$ , around a portion of central depression 35. Angle $\alpha$ in this case is greater than 180° and is in a position remote from support tab 32. A horizontal segment 37 is also attached to central depression 35 and conical segment 36. Between conical segment 36 and horizontal segment 37 there are transition segments 38, 39 each of angular extent $\beta$ of about 30°.

An axially disposed element 40 is attached to horizontal segment 37 along its outer periphery 41 and is in contact with the outer surface 42 of outer wall 29. A radially disposed locating element 43 is attached to the axial locating element 40 and is substantially coextensive with and conforms to the surface 44 of support tab 32.

Figure 7:
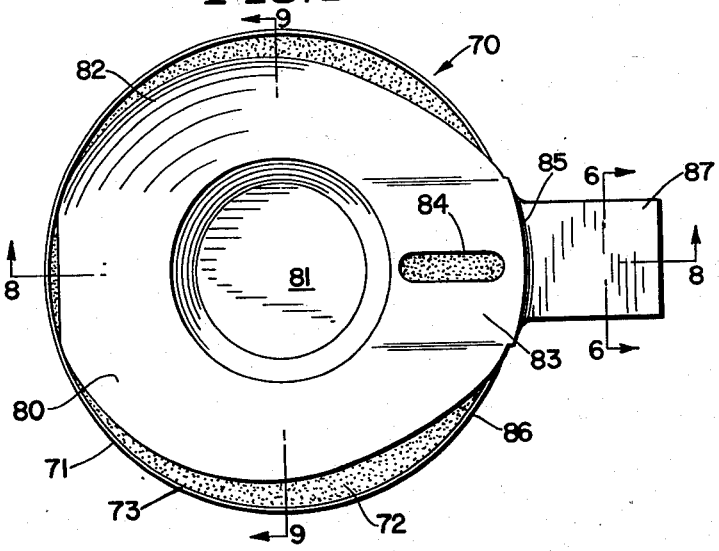
FIG. 7 is a plan view of a preferred getter device of the present invention
Figure 8:
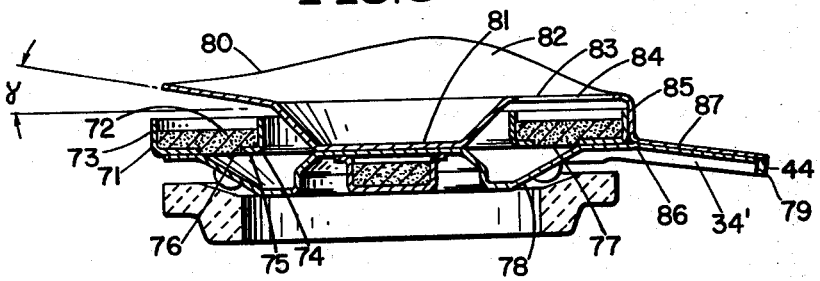
FIG. 8 is a sectional view taken along line 8 — 8 of FIG. 7.
Figure 9:
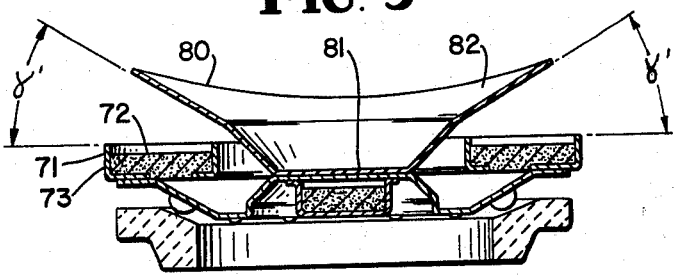
FIG. 9 is a sectional view taken along line 9 — 9 of FIG. 7.

FIGS. 7 to 9 show a second embodyment of a getter device 70 of the present invention. The getter device 70 comprises an annular ring 71 supporting a getter metal vapour releasing material 72. Annular ring 71 comprises an outer wall 73, an inner wall 74, and a bottom wall 75. In bottom wall 75 are holes 76, 77.

The getter device further comprises a disc-member 78, to which is attached a support tab 79, and a conical deflector 80.

Edges 34, 34' of support tab 79 (identical to support tab 32 of getter device 20) are bent substantially at right angles to strip 33 to make a more rigid structure.

Deflector 80 comprises a central depression 81, a conical segment 82 disposed around a portion of the central depression 81 and a horizontal segment 83 attached to the central depression 81 and the conical segment 82. Horizontal segment 83 contains a radially disposed slit 84 to prevent overheating of the deflector when getter device 70 is subjected to induction heating.

An axially disposed locating element 85 is in contact with outer surface 86 of outer wall 73.

A radially disposed locating element 87 is attached to the axially disposed locating element 85 and is substantially co-extensive with and conforming to the surface 44 of the support tab 79.

Conical deflector 80 makes an angle $\alpha$ with the plane containing annular ring 71. At the position remote from the axially disposed locating element 85 angle $\alpha$ is about 10°. Angle $\alpha$ continuously varies until it reaches a maximum value of $\alpha'$, about 30°, at positions at right angles from the locating element 85.

Although the invention has been described in considerable detail with reference to certain preferred embodiments thereof, it will be understood that variations and modifications can be effected within the spirit and scope of the invention as described above and as defined in the appended claims.

What is claimed is:

1. A getter device for releasing barium while mounted in a cathode ray tube in the antenna position, said device comprising:

A. an annular ring container of U-shaped cross section having an outer wall, an inner wall and a bottom wall joining said outer wall to said inner wall and B. a barium releasing material within said annular ring and C. a support tab having at least one substantially flat surface, attached to said annular ring and extending radially outwards beyond the outer wall of said annular ring and D. a deflector comprising a. a central depression, b. a conical segment positioned around at least a portion of the central depression, c. a radially extending segment attached to the central depression and the conical segment, d. an axial locating element attached to the radially extending segment said axial locating element contacting said outer wall of said annular ring, e. a radial U-shaped cross section locating element attached to the axial locating element and substantially co-extensive with and conforming to the surface of said support tab.

2. A getter device of claim 1 in which the radially extending segment attached to the central depression and the conical segment contains a radially disposed slit.

3. A getter device of claim 1 in which the conical segment of the deflector makes an angle with the plane of the annular ring varying from a minimum of 10° to a maximum of 30°.

4. A getter device of claim 3 in which the minimum angle is at a position furthest from the support tab.

* * * * *